United States Patent [19]

Boyer

[11] 4,010,042

[45] Mar. 1, 1977

[54] PROCESS FOR REMOVING PHOSPHOSILICATE COATINGS

[75] Inventor: Charles D. Boyer, Natrona Heights, Pa.

[73] Assignee: Allegheny Ludlum Industries, Inc., Pittsburgh, Pa.

[22] Filed: Jan. 15, 1976

[21] Appl. No.: 649,382

[52] U.S. Cl. ..... 134/2; 134/42

[51] Int. Cl.[2] ..... B08B 3/08

[58] Field of Search ..... 134/2, 42; 252/79.3; 156/15, 17; 427/156, 273; 148/6.15 R, 6.16

[56] References Cited

UNITED STATES PATENTS

| | | | |
|---|---|---|---|
| 2,043,025 | 6/1936 | Wooles | 156/15 |
| 3,015,589 | 1/1962 | Everson et al. | 134/42 |
| 3,310,495 | 3/1967 | Masuda et al. | 252/79.3 X |
| 3,497,407 | 2/1970 | Esch et al. | 252/79.3 X |
| 3,642,549 | 2/1972 | Couture et al. | 156/15 X |
| 3,703,419 | 11/1972 | Esler et al. | 148/6.16 |
| 3,798,074 | 3/1974 | Esler et al. | 148/6.16 |

*Primary Examiner*— S.Leon Bashore
*Assistant Examiner*—Marc L. Caroff
*Attorney, Agent, or Firm*—Vincent G. Gioia; Robert F. Dropkin

[57] ABSTRACT

A phosphosilicate coating is removed from a metallic substrate by contacting the coating with an aqueous solution containing an alkali metal fluoride. The solution is maintained in contact with the coating for a time sufficient to remove the coating without harming the substrate.

9 Claims, No Drawings

PROCESS FOR REMOVING PHOSPHOSILICATE COATINGS

This invention relates to the removal of phosphosilicate coatings, and more particularly to an improved process for removing phosphosilicate coatings from a variety of substrates, including metal substrates, without deleteriously affecting the substrate.

It has frequently been the practice to color stainless steel for various decorative applications, including water fountains, furniture trim, sinks and the like. Most frequently, stainless steels are given a bronze color, generated on the stainless steel surfaces through a process of controlled oxidation of the stainless steel surface. One of the difficulties with such surfaces is that they are easily scratched, smeared by the oils contained in natural skin as well as other contaminants found on hands, weathered by atmospheric conditions and stained by a variety of solvent or like chemicals. As a result, it has been necessary to coat the colored surface to thereby render the oxide formed during the color generation permanent to provide protection to the oxidized, stainless surfaces.

Compositions for coating metallic surfaces to impart protection thereto are described in U.S. Pat. Nos. 3,703,419 and 3,798,074, the disclosures of which are incorporated herein by reference. As is described in the foregoing patents, a protective coating is applied to a substrate, most frequently a metallic substrate, by contacting the substrate with an aqueous solution containing phosphate, chromate, ammonium and silicate ions so as to form on the surface of the metal a coating which is substantially water soluble and transparent and which offers protection from marring, marking and staining of stainless steel surfaces. Without limiting the invention as to theory, it is believed that the coating is formed of polymeric chains of phosphorus, chromium, oxygen and silicon atoms with or without magnesium cations. Such coatings are now known in the art as phosphosilicate coatings.

As is described in the foregoing patents, substrates, and particularly metallic substrates, which have been provided with a phosphosilicate coating, are particularly resistant to scratching, marring and stains.

On occasion, parts which have been colored and coated with a phosphosilicate coating do not meet standards established for a particular application, and that particular part is consequently rejected because, for example, it has a flaw in the coating caused by a malfunction in spraying equipment. It is then necessary, in an effort to recover or reprocess the article, to remove the phosphosilicate coating.

In the past, it has been the practice to mechanically remove the phosphosilicate coating, as by grinding, prior to reprocessing of the stainless surface. When the phosphosilicate coating is removed by grinding, it becomes necessary thereafter to recolor the substrate after the grinding operation is completed.

One of the difficulties with mechanical removal of the phosphosilicate coating has been that the hardness of the coating makes grinding very difficult. In addition, the grinding operation completely destroys the colored oxide coating so that it is necessary, in reclaiming the article, to recolor the substrate prior to recoating it.

It is accordingly an object of the invention to provide a process for the removal of phosphosilicate coatings which overcomes the foregoing disadvantages.

It is a more specific object of this invention to provide a process for the chemical removal of phosphosilicate coatings which is capable of rapidly removing the coating without deleteriously affecting the substrate or its color.

The concepts of the present invention reside in the discovery that alkali metal fluorides, in aqueous solution, are capable of rapidly removing phosphosilicate coatings of the type described in the foregoing patents without deleteriously affecting the substrate or the color imparted to it. Thus, the process of this invention can be used to remove a flawed phosphosilicate coating, after which it is necessary to only recoat the article to apply the phosphosilicate coating. Because the process of this invention does not affect the color of the substrate, it is unnecessary to recolor the substrate following removal of the phosphosilicate coating.

It is surprising that alkali metal fluorides are capable of removing phosphosilicate coatings without deleteriously affecting the metal substrate since other chemical methods for removing inorganic coatings have little or no affect on the phosphosilicate coating, or adversely the color of the stainless substrate. For example, ammonium fluoride, a close relative of potassium and sodium fluorides has been found to be either ineffective in the removal of a phosphosilicate coating or, if sufficiently concentrated to remove the coating, to cause the substrate to become blackened in those areas where the phosphosilicate coating has been removed.

In accordance with the practice of this invention, the substrate containing the phosphosilicate coating on the surface thereof is simply contacted with an aqueous solution of the alkali metal fluoride, preferably sodium fluoride or potassium fluoride, maintained at an elevated temperature. The temperature at which the solution is maintained is not critical and can be varied within fairly wide limits, with higher temperatures favoring more rapid removal of the phosphosilicate coating. In general, it has been found that best results are usually obtained when the aqueous solution of the alkali metal fluoride is maintained at a temperature ranging from 80° F up to the boiling point of the solution, and preferably a temperature within the range of 120°–190° F.

Similarly, the concentration of the alkali metal fluoride in the aqueous solution is not critical. It has been found that the more concentrated the solution, the more rapid is the rate of removal of the phosphosilicate coating. For most applications, it is sufficient to use an aqueous solution containing from 5% of the alkali metal fluoride up to an amount corresponding to the amount of alkali metal fluoride required to saturate the solution, and preferably 10–60% by weight alkali metal fluoride. As will be appreciated by those skilled in the art, the temperature of the aqueous solution, its concentration and the time during which the solution is in contact with the phosphosilicate coating are variables which are all interrelated. It is frequently desirable to use shorter contact times with higher solution temperatures and/or more concentrated solutions.

One of the surprising features of this invention is that potassium fluoride is far superior to even sodium fluoride in the removal of phosphosilicate coatings. It has been found, for example, that potassium fluoride is capable of removing a phosphosilicate coating approximately four times faster than sodium fluoride at the same concentration and the same temperature. Thus, potassium fluoride has been found to be particularly well suited in the practice of this invention.

The process of the present invention is applicable to the removal of phosphosilicate coatings from many substrates, and particularly metallic surfaces. The invention has been found highly suitable in the removal of phosphosilicate coatings from stainless steel, brass, aluminum, silver, zinc, copper, carbon steels, lead, chromium, nickel plate, black chrome or platinum. The concepts of the present invention have their most important application to the removal of phosphosilicate coatings from stainless steels since stainless steels are most frequently coated with the phosphosilicate coating in view of their susceptibility to marring, scratching and staining.

Having described the basic concepts of the present invention, reference is now made to the following example, which is provided by way of illustration, and not by way of limitation, of the practice of this invention and the advantage of this invention as compared to other known chemical stripping solutions.

EXAMPLE

Various aqueous chemical stripping solutions were formulated by dissolving various salts in water, and then testing their efficiency in the removal of phosphosilicate coatings by contact with stainless steels, having phosphosilicate coatings in the thicknesses indicated, at a temperature of 160° F. The substrate was simply immersed in the solution, and allowed to remain there for the time indicated.

The results of these tests are set forth in the following table.

| Stripping Solution | Concentration at 160° F | No. 4 Finish-Type 304-Color and Coated at 20 μ in. | 2DVB Finish-Type 434 Clear Coated at 31 μ in. | B.A. Type 434 Clear Coated at 22 μ in. |
|---|---|---|---|---|
| $NaNo_3$ | 20% (Clear) | — | Not affected-2 days | — |
| | 50% (Clear) | — | Not affected - 2 days | — |
| NaC1 | 20% (Clear) | Not affected - 2 days | Not affected - 2 days | — |
| | 50% (Clear) | Not affected - 2 days | Not affected - 2 days | — |
| NaF | 20% (Light Residue) | Stripped 15 hours Color not affected | — — | — |
| | 50% (Heavy Residue) | — — | 80% Stripped - 2 days Metal - not affected | — — |
| $NH_4F$ | 20% (Clear) | Coating not affected 30 Mins. Color changed-30 min. | — | — |
| | 50% (Heavy Residue) | — | Metal blackened on Stripped areas - 30 min. | — |
| KF | 20% (Clear) | Stripped - 4hrs. Color not affected | — | — |
| | 50% (Clear) | Color - not affected after 24 hours | Stripped - 12 hrs. Metal - not affected | Stripped - 4 hours Metal - not affected |
| | 75% (Clear) | 60% Stripped - 5 hrs. Color changed - 5 hours | Stripped - 12 hours Metal - not affected | Metal - not affected |

The terms "clear", "light residue", and "heavy residue" indicates the solubility of the salts at the noted concentrations as the solutions were mixed, and the condition of the stainless steel sample was also noted.

The foregoing results indicate that sodium nitrate did not affect the coating on the substrate against which it was tested. Similar results were noted for sodium chloride.

Ammonium fluoride in a concentration of 20% did not affect the coating for 30 minutes, and thereafter caused a color change. The same salt in a concentration of 50% produced blackened metal after 30 minutes on another sample.

In contrast, potassium fluoride and sodium fluoride were both effective in the removal of the phosphosilicate coating. Potassium fluoride was far superior to sodium fluoride since the potassium fluoride effected removal of the phosphosilicate coating approximately four times as fast as the sodium fluoride. Those tests demonstrate the unexpected superiority of potassium fluoride solution in the removal of phosphosilicate coatings.

It will be understood that various changes and modifications may be made in the details of procedure and use without departing from the spirit of the invention, especially as defined in the following claims.

I claim:

1. A process for removing a phosphosilicate coating from a metallic substrate, without deleteriously affecting the substrate, comprising contacting the coating with an aqueous solution containing an alkali metal fluoride in a concentration effective to remove the phosphosilicate coating and maintaining said solution in contact with said coating for a time sufficient to remove the phosphosilicate coating without deleteriously affecting the substrate.

2. A process as defined in claim 1 wherein the fluoride is sodium fluoride or potassium fluoride.

3. A process as defined in claim 1 wherein the fluoride is potassium fluoride.

4. A process as defined in claim 1 wherein the coating is contacted with the aqueous solution at a temperature within the range of 80° F up to the boiling point of the solution.

5. A process as defined in claim 1 wherein the aqueous solution contains the fluoride in a concentration ranging from 5% by weight up to the saturation concentration.

6. A process as defined in claim 1 wherein the substrate is a stainless steel.

7. A process as defined in claim 6 wherein the stainless steel substrate is a colored substrate which has been colored by controlled oxidation.

8. A process for removing a phosphosilicate coating from a stainless steel substrate, without deleteriously affecting the substrate, comprising contacting the coating with an aqueous solution containing potassium fluoride in a concentration effective to remove the phosphosilicate coating and maintaining said solution in contact with said coating for a time and at a temperature sufficient to remove the phosphosilicate coating without deleteriously affecting the substrate.

9. A process as defined in claim 8 wherein the stainless steel substrate is a colored substrate which has been colored by controlled oxidation.

* * * * *